US005249806A

United States Patent [19]

Nathanson

[11] Patent Number: 5,249,806

[45] Date of Patent: Oct. 5, 1993

[54] MINEFIELD GAME

[76] Inventor: Albert Nathanson, 152 Conifer Cir., Agoura Hills, Calif. 91301

[21] Appl. No.: 941,881

[22] Filed: Sep. 8, 1992

[51] Int. Cl.[5] ..... A63F 3/00

[52] U.S. Cl. ..... 273/238

[58] Field of Search ..... 273/241, 237, 238, 264, 273/271, 287

[56] References Cited

U.S. PATENT DOCUMENTS

| | | | |
|---|---|---|---|
| 1,232,133 | 7/1917 | Warden | 273/255 X |
| 3,884,473 | 5/1975 | Pritulsky | 273/255 |
| 4,023,807 | 5/1977 | Santianni | 273/238 |
| 4,231,577 | 11/1980 | Thomas et al. | 273/238 |
| 4,365,811 | 12/1982 | Krzes | 273/238 |
| 4,796,891 | 1/1989 | Milner | 273/238 X |
| 4,848,767 | 7/1989 | Correro | 273/238 X |
| 4,969,650 | 11/1990 | Magara et al. | 273/238 |
| 5,121,927 | 6/1992 | Jones | 273/260 X |

*Primary Examiner*—William Stoll
*Attorney, Agent, or Firm*—Jack C. Munro

[57] ABSTRACT

A game which is to simulate a mine field which has a game board assembly constructed of a lower game board and an upper game board with an open playing area located therebetween. Within the open playing area on the lower game board of the game board assembly is to be locatable one or more first playing members at various first playing piece locations. Each first playing member includes an annunciator. A second playing member is to be locatable at any one of a multitude of second playing piece locations on the upper game board. The second playing members are to be moved across the upper game board and if a second playing member becomes in direct vertical alignment with the first playing member, the annunciator for that first playing member is activated.

7 Claims, 2 Drawing Sheets

MINEFIELD GAME

BACKGROUND OF THE INVENTION

1) Field of the Invention

The field of this invention relates to games and more particularly to a game which is to simulate a mine field such as would occur within a war.

2) Description of the Prior Art

Numerous different types of games have long been known. The function of any game is to entertain. A common form of entertainment for a human is to have the game be challenging. The challenge occurs by the players of the game having to take certain risks and, if successful, a player is to be rewarded. If the player is not successful, the player is penalized.

SUMMARY OF THE INVENTION

The structure of the present invention is to directed to a game in which the player must inherently take risks. If the player is successful, the player is rewarded, and if the player is not successful, the player is immediately penalized. The game of the present invention utilizes a game board assembly which is constructed of an upper section and a lower section with there being an open playing area located between the upper game board and the lower game board. The upper game board of the game board assembly is opaque. Both the upper game board and the lower game board are electrically conductive. A particular type of playing member is to be locatable within the open area and in electrical connection with the lower game board. This playing member includes a small explosive device. Another type of playing member is to be movable across the upper game board and if this type of playing member becomes vertically aligned with the first type of playing member, activation of a small explosive charge will occur thereby letting the players know that a "mine" has been found. A certain number of mine type playing members are utilized as well as a certain number of playing members that are removable across the upper game board. The objective of the game is to have a player move as many of the playing members across the upper game board as is possible without being destroyed by the "mines".

One objective of the present invention is to construct a game which is exceedingly challenging and interesting to human players regardless of age.

Another objective of the present invention is to construct a game which can be manufactured relatively inexpensively and therefore sold to the ultimate consumer at an inexpensive price.

DETAILED DESCRIPTION OF THE SHOWN EMBODIMENT

Figure 1:
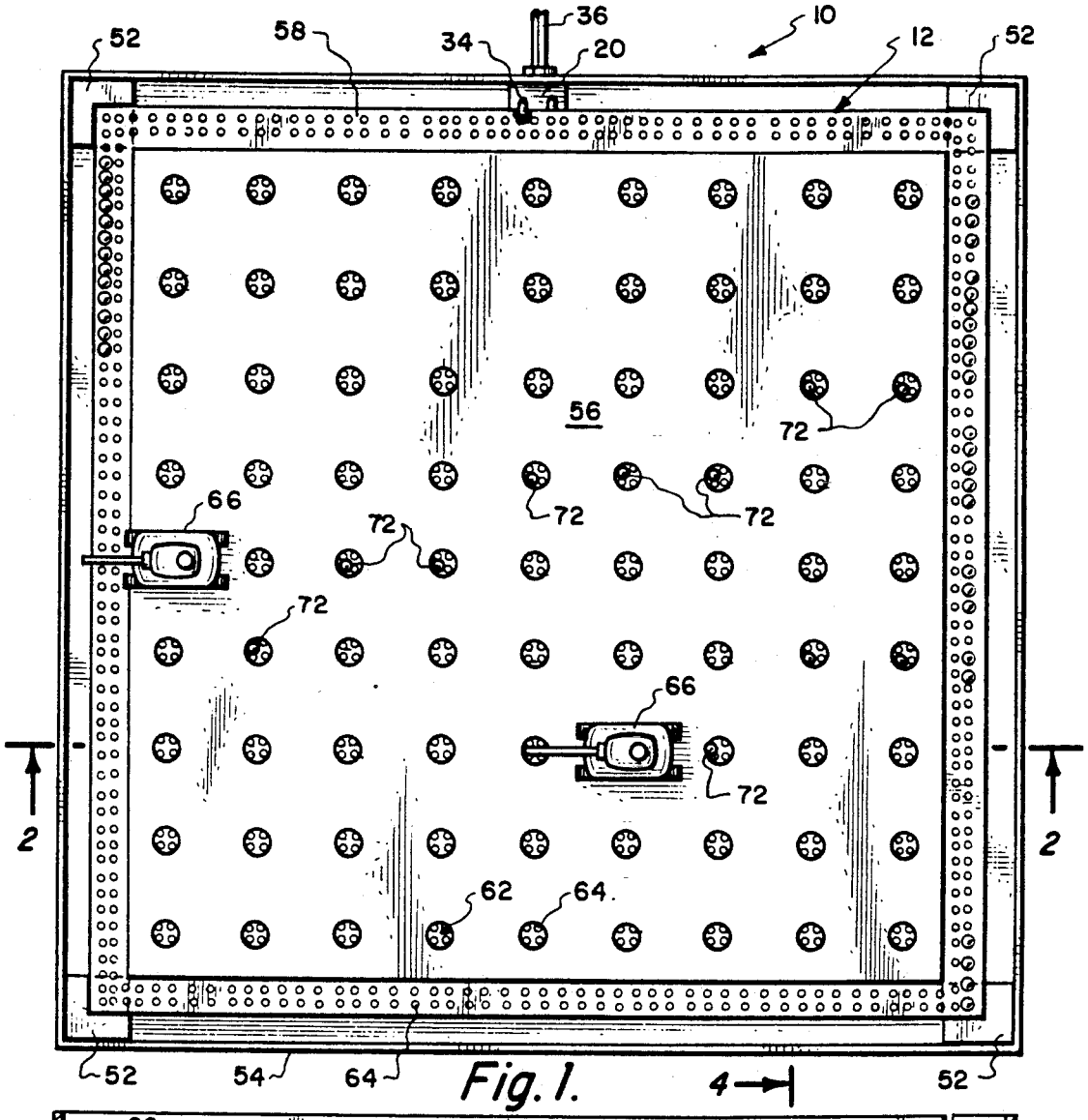
FIG. 1 is a top plan view of the upper game board of the game board of the present invention depicting movement of the playing members on the upper game board.
Figure 2:
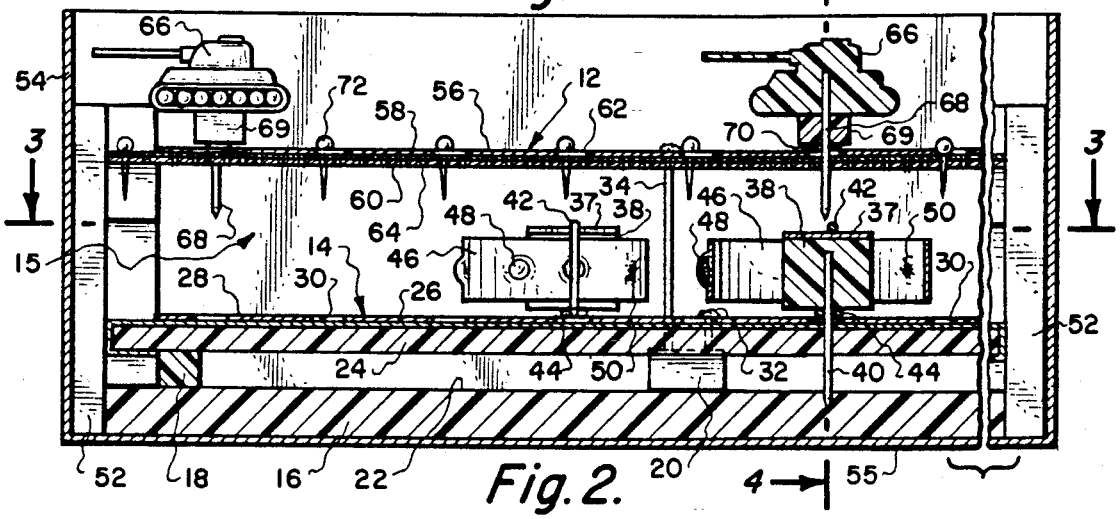
FIG. 2 is a transverse cross sectional view through the game board taken along line 2—2 of FIG. 1.

Referring particularly to the drawings, there is shown the game of this invention which is composed primarily of game board assembly 10. Game board assembly 10 is composed of an upper game board 12 and a lower game board 14 with upper game board 12 and lower game board 14 basically square in configuration and each are of the same size. However, the size dimensions of the upper game board 12 and lower game board 14 could vary slightly. The upper game board 12 is basically planar in configuration as is the lower game board 14. In between the upper section 12 and the lower game board 14 is a space which is defined as a playing area 15.

The lower game board 14 includes a base 16. The base 16 is constructed of a rigid material but is designed to be readily penetratable by a sharp pointed object. Typical construction for the base 16 would be a foam material constructed of expanded polystyrene beads, cardboard or other similar type of product. At each corner of the base 16 is mounted a vertically upstanding post 52. Encasing the post 52 is a planar upstanding sidewall 54. The sidewall 54 will normally comprise a sheet material plastic. Located across the bottom of the base 16 and integrally connected to the sidewall 54 is a similar type of plastic material forming a bottom 55. Post 52, sidewall 54 and bottom 55 form a mounting frame for the game boards 12 and 14 to maintain their desired necessary spacing therebetween.

The lower game board also includes a plurality of block like spacers 18. These spacers 18 are located on the upper surface of the base 16. Normally the blocks 18 will be constructed of a readily penetratable material such as a foam plastic or cardboard. However, a non-penetratable material could be utilized if the blocks 18 are stratically placed so that they would not be capable of being penetrated. Mounted on the blocks 18 is a planar member 24. The planar member 24 is to be constructed of a readily penetratable material. Once again, a foam plastic or cardboard material is preferred. In between the planar member 24 and the base 16 is located a space 22.

Figure 3:
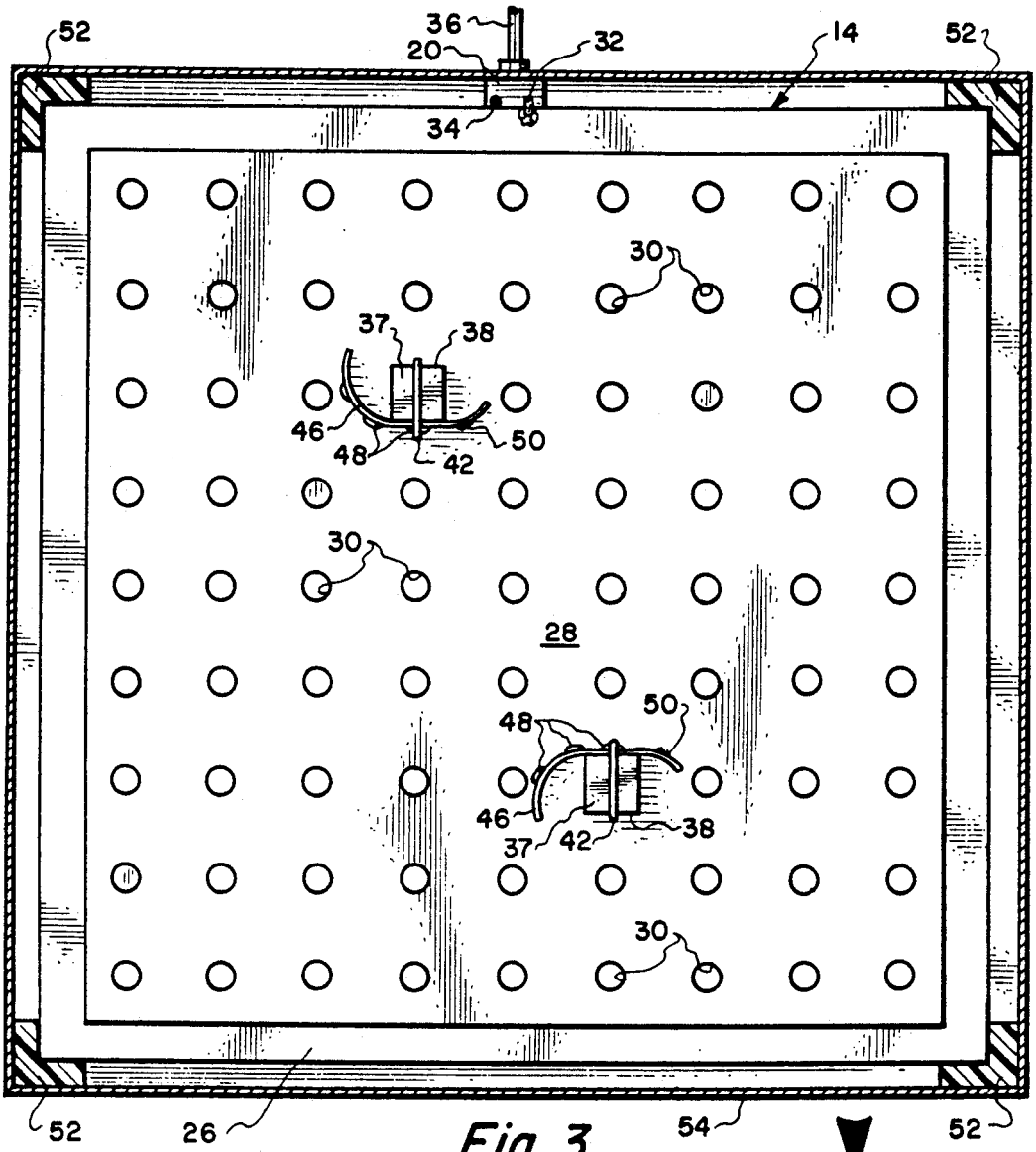
FIG. 3 is a top plan view of the lower game board of the game board assembly present invention showing a couple of the "mine" playing members mounted thereon.
Figure 4:
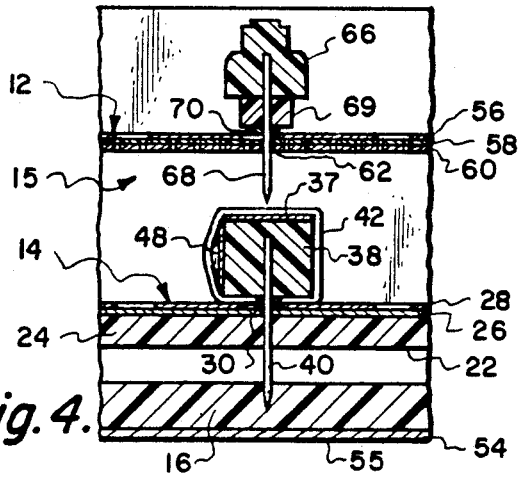
FIG. 4 is a transverse cross sectional view taken along line 4—4 of FIG. 2 showing vertical alignment occurring between a playing member on the upper game board and one of the "mine" playing members on the lower game board but where activation of the annunciator associated with the "mine" playing member has not yet occurred.
Figure 5:
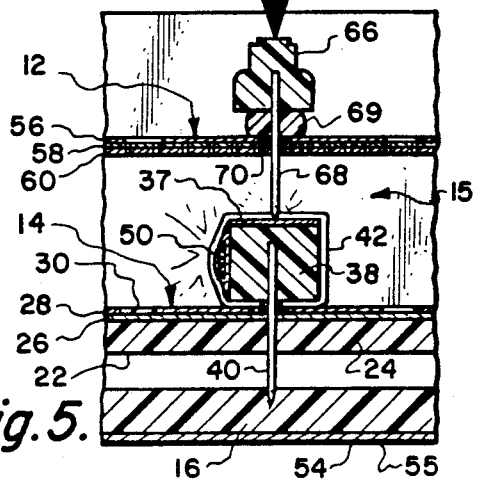
FIG. 5 is a view similar to FIG. 4 but showing activation of the annunciator.

Covering the upper surface of the planar member 24 is an electrically conductive layer 26 of material with a common such material comprising a metallic foil. Covering the upper surface of the foil 26 is a thin paper layer 28. The paper layer 28 has formed therein a series of holes 30. The holes 30 are evenly spaced apart and arranged in a series of columns and rows with 81 such holes being shown in FIG. 3 of the drawings. All the holes 30 are of the same size.

Mounted on the base 16 is an electrical connecting block 20. This electrical connecting block 20 is to be connected by electrical conductor 36 to a battery source of electrical power (not shown). An electrical conductive pin 32 connects foil layer 26 to the block 20.

A mine type of playing member formed primarily of a block 38 is to be locatable against the paper layer 28. Imbedded within the block 38 is a sharp pointed pin 40. The upper surface of the block 38 has an electrically conductive metallic layer 37 placed thereon. Typical material for the layer 37 would be copper. Against the sidewall of the block 38 is placed a paper strip 46 which has a plurality of spaced apart small explosive charges 48 included therein. These charges 48 and the strip 46 are what is frequently known as "caps". These charges 48 are capable of being ignited or exploded forming an exploded charge 50.

Igniting of the charge 48 is caused by wire 42 which is placed against the outer surface of a single charge 48. The wire 42 surrounds the block 38 and is wound about the pin 40 forming a wire tie 44. This wire tie 44 is to come into direct contact with the foil 26 forming an electrical connection between the wire 42, pin 40, foil 26, electrical connector 20 and electrical connector 36. It is to be understood that when one explosive charge 48 is ignited that the strip 46 is then to be moved so that another unexploded charge 48 can be located directly in contact with the wire 42. It is also to be understood that there will be utilized several blocks 38 with generally a common number being five or six with only two being shown in the drawings. A block 38 is to connect with a hole 30 and it will be the option of the player as to which hole 30 a block 38 is to be connected. Prior to the playing of the game, an opposing player, or the player who will not be actually playing the game, is to "strategically" place the blocks 38 on the lower game board 14 at various locations.

The upper game board 12 is to be removably mounted on the upstanding posts 52. The upper game board 12 is to be opaque so that when the upper section 12 is located at its position on the posts 52 that it will be impossible for the player of the game to ascertain the position of the mines known as blocks 38. The upper section 12 is composed generally of a lower layer 60 which is rigid but yet penetratable by a sharp pointed instrument with a desirable type of material being a cardboard layer or possibly even a plastic. Placed on top of the layer 60 is an electrically conductive layer 58 with generally a thin strip of metal material being preferred. This layer 58 includes a mass of closely spaced tiny holes 64. The layer 58 is not designed to be penetratable by a sharp pointed pin. However, the pin is capable of passing through any one of the holes 64.

Placed on top of the layer 58 and substantially covering most of the holes 64 is a paper layer 56. The paper layer 56 is basically identical to paper layer 28 and includes the same sequence of holes 62. Actually, each hole 62 is of the same size and is to be in direct vertical alignment with a hole 30. The size of each hole 62 is such that it encompasses approxmately four in number of the holes 64. Electrically connected to the layer 58 is an electrically conductive pin 34. This pin 34 connects with block 20.

Locatable against the upper surface of the layer 56 are a plurality of playing members 66. Playing members 66 happen to be shown as representing a tank that is commonly used in conjunction with war. However, the playing member 66 could occupy any desired configuration. Fixedly mounted within the playing member 66 is a sharp pointed pin 68. This sharp pointed pin 68 extends through a resilient pad 69 which is mounted against the undersurface of the playing member 66. Mounted against the lower or bottom surface of the pad 69 is an electrically conductive metallic washer 70. This washer 70 is of a size slightly smaller than each hole 62 and is capable of coming into direct contact with the layer 58. The player starts at one edge of the upper game board 12 and places a playing member 66 in contact with one hole 62. The pin 68 for the playing member 66 connects with one of the four holes 64 with the pin 68 then passing through layer 60 into the playing area 15. Pin 68 is continued to be pressed downward until metallic disc 70 comes in contact with metallic layer 58. Continued pressure downward compresses resilient pad 69. If, per chance, the pin 68 comes into contact with metallic layer 37 of a block 38, a completed electrical circuit will be established, causing wire 42 to be heated and quickly cause ignition of the small explosive charge 48 with which the wire 42 is connected. The charge 48 explodes creating a small noise indicating to the player that a "mine" has been ignited and that playing member 66 is now "lost". The player is then to remove that playing member 66 from the upper game board 12 of the game board assembly 10. Since a playing member 66 has occupied that particular hole 62, the player is to place a small pin type of playing member 72 into that particular hole 62 which indicates to the player that usage of that particular hole 62 has occurred and therefore no further playing member 66 is to occupy that particular hole 62.

If a playing member 66 does not engage with a "mine" when associated with a particular hole 62, the player is then permitted to move that particular playing member to another hole 62. The player can move the playing member 66 to any directly adjacent hole either in a straight line or diagonally. However, in playing of the game, the player must move to a directly adjacent hole and is not able to skip holes 62. The objective of the game is for the player to move as many playing members 66 to the opposite side edge of the upper game board 12 and avoid losing of one or more of the playing members 66 by such coming into contact with a "mine".

There may also be included within the electrical circuitry a light that will be activated upon a "mine" being encountered. This light could be utilized in lieu of the small explosive charges 48 if such is deemed to be desired. Associated with the game of this invention there will be utilized a timing mechanism which limits the amount of time that the player can move playing members 66 from one edge of the upper section 12 to the opposite edge of the upper section 12. There generally will be utilized five or six of the playing members 66. It is to be understood that each time a playing member 66 leaves a hole 62, that a playing member 72 will then be placed within that hole 62.

What is claimed is:

1. A game comprising:

a game board assembly formed of a lower gameboard and an upper gameboard, said upper game board being spaced from said lower game board forming an open playing area therebetween;

a first playing member being locatable at any one of a multitude of first playing piece locations on said lower game board within said open playing area, said first playing member including means for annunciating;

a second playing member being locatable at any one of a multitude of second playing piece locations on said upper game board, said upper game board being opaque, penetration means connected to said second playing member, said penetration means to penetrate said upper game board and extend within said open playing area, said penetration means to contact said first playing member upon said second playing member being in vertical alignment with said first playing member, said contact to cause activation of said means for annunciating; and said means for annunciating comprising a small explosive charge.

2. The game as defined in claim 1 including:

a third playing member to be locatable on said upper game board, said third playing member to occupy a position on said upper game board that has been previously occupied by said second playing member during playing of a single game, with said third playing member occupying one of said second playing piece locations said second playing member is not capable of occupying that said second playing piece location.

3. The game as defined in claim 1 wherein:

a mounting frame which is part of said game board assembly, said lower game board being fixedly mounted within said mounting frame, said upper game board being removably mounted within said mounting frame, whereby said upper game board being removable permitting access into said open playing area to affect movement of said first playing member from one of said first playing piece locations to another said first playing piece location.

4. The game as defined in claim 1 wherein:

each said first playing piece location being vertically aligned with a single said second playing piece location.

5. The game as defined in claim 1 wherein:

there being an equal number of said first playing piece locations and said second playing piece locations.

6. The game as defined in claim 1 wherein:

said first playing piece location being substantially evenly spaced apart and said second playing piece location being substantially evenly spaced apart.

7. The game as defined in claim 1 wherein:

said upper game board being electrically conductive, said lower game board being electrically conductive, said penetration means being electrically conductive, said second playing member being electrically conductive, upon said penetration means coming into contact with said second playing member an electrical circuit is completed causing activation of said means for annunciating.

* * * * *